US009336756B2

(12) United States Patent
Vochezer

(10) Patent No.: US 9,336,756 B2
(45) Date of Patent: May 10, 2016

(54) CHIN REST, CHIN REST SYSTEM AND MUSICAL INSTRUMENT

(71) Applicant: Wittner GmbH & Co. KG, Isny (DE)

(72) Inventor: Georg Vochezer, Argenbuehl-Christazhofen (DE)

(73) Assignee: Wittner GmbH & Co. KG, Isny (DE)

( * ) Notice: Subject to any disclaimer, the term of this patent is extended or adjusted under 35 U.S.C. 154(b) by 166 days.

(21) Appl. No.: 14/177,560

(22) Filed: Feb. 11, 2014

(65) Prior Publication Data

US 2014/0190330 A1 Jul. 10, 2014

Related U.S. Application Data

(63) Continuation of application No. PCT/EP2012/067059, filed on Sep. 3, 2012.

(30) Foreign Application Priority Data

Sep. 5, 2011 (DE) ..... 10 2011 053 285

(51) Int. Cl.
*G10D 3/18* (2006.01)

(52) U.S. Cl.
CPC ..... *G10D 3/18* (2013.01)

(58) Field of Classification Search
CPC ..... G10D 3/18; G10G 5/005; G10G 5/00; H04R 1/026; H04R 1/345
USPC ..... 84/279–281
See application file for complete search history.

(56) References Cited

U.S. PATENT DOCUMENTS

| | | | |
|---|---|---|---|
| 439,199 | A | 10/1890 | Schuster |
| 714,658 | A | 12/1902 | Barginde |
| 1,204,642 | A | 11/1916 | Becker |
| 3,175,446 | A | 3/1965 | Menuhin et al. |
| 3,683,098 | A | 8/1972 | Chavez, Jr. |
| 6,268,555 | B1 | 7/2001 | Vochezer |
| 7,531,727 | B2 | 5/2009 | Buttemer |

FOREIGN PATENT DOCUMENTS

| | | | | |
|---|---|---|---|---|
| DE | 359 170 | | 9/1922 | |
| DE | 503 666 | | 7/1930 | |
| DE | 621 416 | | 11/1935 | |
| DE | 1 017 891 | | 10/1957 | |
| DE | 43 02 804 | | 2/1994 | |
| DE | 195 32 900 | | 3/1997 | |
| DE | 202 08 751 | | 10/2002 | |
| EP | 1 067 508 | | 1/2001 | |
| GB | 000295753 | A * | 8/1928 | ..... G10D 3/18 84/279 |
| GB | 295753 | A * | 8/1928 | ..... G10D 3/18 |

* cited by examiner

*Primary Examiner* — Kimberly Lockett
(74) *Attorney, Agent, or Firm* — Lipsitz & McAllister, LLC

(57) ABSTRACT

Provided is a chin rest for a musical instrument, comprising a chin support, a holding device for holding the chin support on the musical instrument and at least one support foot via which the chin support supports itself on a top of the musical instrument, wherein the at least one support foot is releasably arranged on the chin support.

26 Claims, 7 Drawing Sheets

CHIN REST, CHIN REST SYSTEM AND MUSICAL INSTRUMENT

This application is a continuation of international application number PCT/EP2012/067059 filed on Sep. 3, 2012 and claims the benefit of German application number 10 2011 053 285.4 filed on Sep. 5, 2011, which are incorporated herein by reference in their entirety and for all purposes.

BACKGROUND OF THE INVENTION

The invention relates to a chin rest for a musical instrument, comprising a chin support, a holding device for holding the chin support on the musical instrument and at least one support foot via which the chin support supports itself on a top of the musical instrument.

The invention further relates to a chin rest system.

Furthermore, the invention relates to a musical instrument.

EP 1 067 508 A2, or U.S. Pat. No. 6,268,555 B1, discloses a chin rest for a musical instrument, comprising a chin support and a holding device for holding the chin support on the musical instrument, with the holding device comprising at least one clamping element which is adjustable in a clamping direction for clamping the chin support with the musical instrument. The chin support comprises an insertion guide for the at least one clamping element, and the insertion guide is arranged and configured such that the inserting direction is at an incline to the clamping direction.

DE 43 02 804 C2 discloses a chin rest for instruments of the violin type, comprising a carrier which is formed from tube sections and adjoins a chin rest.

DE 359 170 discloses a chin rest in which the chin support is attached to the instrument by turnbuckle clamps.

DE 621 416 discloses a violin holder which is adjustable in height and direction and in which the elongate upper holder which serves to hook behind the jaw bone is connected to the upper clamp jaw of the clamping device attached to the violin body so as to be fully or partially movable in the sense of a ball joint and adjustable.

DE 202 08 751 U1 discloses a chin rest for string instruments which receives on its underside two set screws which are infinitely variably threadable into the chin rest by way of the thread that is preferably provided in threaded sleeves, thereby realizing any desired and also differing distance of the set screws, for support against the instrument top.

U.S. Pat. No. 7,531,727 B2 discloses a chin rest for a musical instrument, comprising a body, a first support, a second support, a chin pad and a third support. The first support extends from a first end portion of the body and has at least one clamp for engaging an upper rim of a musical instrument body. The second support extends from a second end portion of the body and has at least one clamp for engaging the upper rim of the musical instrument body at a location spaced apart from the first support. The chin pad includes a chin-receiving surface and is coupled to the body. The third support may contact a position along the upper rim of the musical instrument.

DE 195 32 900 A1 discloses an ergonomically, individually shaped and made chin support in which a model is formed from an impression, using a prefabricated cup, a plastic material and a hardener.

A further chin support is disclosed in U.S. Pat. No. 3,683,098.

SUMMARY OF THE INVENTION

In accordance with an embodiment of the invention, a chin rest is provided that can be used in a simple and variable manner.

In accordance with an embodiment of the invention, the chin rest comprises at least one support foot which is releasably arranged on the chin support.

With the solution in accordance with the invention, a user of the chin rest can readily adapt the chin support's position relative to the top of the musical instrument to suit his or her particular requirements by selecting the suitable at least one support foot. By way of example, the user can thereby experiment with different height distances of the chin support relative to the top of the musical instrument or also, for example, with different tilt positions.

These adjustment options can be achieved on the same chin rest by replacing the at least one support foot.

By way of example, it is thereby also possible for the chin rest to be easily adapted to changing conditions. For example, the growth of a child user can be allowed for by replacement of support feet. The chin rest can thereby in a sense grow with the child.

Inventory can also be reduced because adaptation to individual requirements is possible by the use of corresponding support feet. The model diversity with respect to chin supports can thereby be reduced.

In particular, the at least one support foot can be released from the chin support when the chin rest is released from the musical instrument.

It is advantageous for the holding device to comprise at least one holding foot which is provided for support against a back of the musical instrument opposite the top, wherein in particular the chin rest is clampable, by way of the holding device, to the musical instrument between the top and the back thereof. This provides a simple way of clamping the chin rest to the musical instrument.

It is advantageous for the at least one support foot to be provided for support on a rim region of the top of the musical instrument in a direction towards a rib. With this arrangement, there is minimal interference with the sound characteristics of the musical instrument.

In particular, it is advantageous for a free space, in particular a free space for a tailpiece, to be formed between the chin support, the at least one support foot and the top of the musical instrument when the chin rest is fixed to the musical instrument. It is thereby possible to have part of the tailpiece pass through the free space. This in turn allows for optimum positioning of the chin rest on the musical instrument. For example, it allows for positioning thereof in the area of an end button for a tailpiece hanger.

In particular, the at least one support foot is arranged at or in the vicinity of an outer edge of the chin support. This allows for simple construction. The chin support can be configured with an optimized, adapted, ergonomic shape.

It is advantageous for at least a first support foot and a second support foot to be provided. A spacing can thereby be formed between these, and said spacing for example permits the passage of a tailpiece hanger therethrough.

It is then advantageous for the first support foot and the second support foot to be spaced apart from each other, with an interspace lying between the first support foot and the second support foot.

It is then further advantageous for the interspace to communicate with a free space between the chin support and the top of the musical instrument when the chin rest is fixed to the musical instrument. In this way, a tailpiece can be positioned with a portion thereof within the free space and a tailpiece hanger fixed to the tailpiece can be passed through the interspace to an end button.

It is particularly advantageous for the holding device to be fixed or fixable to the at least one support foot. The at least one support foot is then used to fix also the holding device with respect to the chin support.

In an exemplary embodiment, the at least one support foot has at least one insertion guide which is arranged and configured such that an associated clamping element of the holding device is capable of being inserted thereinto in an inserting direction that is at an incline to a clamping direction, wherein in particular the clamping element is adjustable in the clamping direction.

A corresponding configuration of a holding device is described in EP 1 067 508 A2, or U.S. Pat. No. 6,268,555 B1, which is incorporated herein and made a part hereof by reference in its entirety and for all purposes.

With use of the insertion guide it is achieved that the clamping element(s) need not be permanently fixedly connected to the chin support, but can be removed by way of the insertion guide when required or can be inserted thereinto for clamping the chin rest with the musical instrument. This provides space-saving storage and transport of the chin rest and makes for quick and easy disassembly and assembly of the chin rest.

Because an insertion guide is provided for the clamping elements, there is more freedom in the choice of materials used for the clamping elements. One is not limited to metals for use as materials for the clamping elements. When using metals, the problem arises that, when the musical instrument and in particular a violin is played, the metal of the clamping elements comes into contact with the skin of the player's neck and face, and these are areas of particularly sensitive skin. This can cause or aggravate allergies such as nickel allergies in persons who are sensitive thereto. In this regard, consideration is also to be given to the fact that the gripping of the musical instrument causes increased pressure on the skin, which additionally increases the risk of developing allergies. Persons who already suffer from allergies cannot use the chin rests known from the prior art.

Furthermore, because the insertion guide eliminates the need to provide the chin rest with threads, the clamping elements can be configured such that there are no allergy-triggering metal parts that come into contact with the player's skin and, in particular, well-tolerated materials can be used. The chin rest therefore conforms to the EU directive 94/27/EC, which regulates the placing on the market of nickel-containing products that come into direct and prolonged contact with the skin and therefore cause allergic reactions, since this contact can be avoided in accordance with the invention.

It is particularly advantageous for the at least one clamping element to be releasably held on the chin support by way of the insertion guide. This provides for space-saving storage and convenient transport of the chin-rest. The insertion of the clamping elements allows for time-effective assembly and corresponding disassembly of the chin rest so that the chin rest, starting from its disassembled state, can also be coupled to the musical instrument in a time-effective manner.

The inserting direction can lie at an angle to the clamping direction, said angle being in the range between 20° and 70°. It is particularly advantageous for this angle to be in the range between 35° and 55°. It is thereby ensured that the clamping element is easy to insert into the insertion guide without causing undue load on a corresponding holding head when the chin rest is clamped. It is particularly advantageous for the angle to be substantially equal to 45° because when the clamping direction is essentially perpendicular to a corpus of the musical instrument, an optimum between good insertability of the clamping element and minimum load during the clamping action can be achieved.

In terms of manufacture, it is particularly advantageous for the insertion guide to be formed by a recess in the chin support. Chin supports are usually made of wood. The insertion guide can then be produced by a simple milling operation on the chin support.

In a variant of an embodiment, provision is made for an insertion guide for a clamping element to comprise a guide channel for the clamping element. The clamping element can thereby be reliably inserted into and also retained in the insertion guide.

To ensure a good hold of the clamping element on the support element when the chin support is being clamped to the musical instrument, and, in particular, to avoid angular misalignment and the like, the insertion guide advantageously comprises a support channel communicating with the guide channel. By way of the support channel, a holding area of the clamping element on the insertion guide can be increased, and, in particular, the forces induced by the clamping action can be absorbed better. To this end, the support channel advantageously comprises a contact face for the clamping element which is substantially perpendicular to or at a small angle to the clamping direction. This enables good absorption of the clamping forces acting between musical instrument and chin support via the clamping element.

It is particularly advantageous for the insertion guide for a clamping element to comprise two separate guide channels. The clamping element is thereby reliably held in the insertion guide and correspondingly easy to insert.

To ensure good clamping between the chin rest and the musical instrument, a clamping element is advantageously of two-part design comprising a connecting element for connection with the chin support and comprising a holding foot for contact with the musical instrument. It is thus possible, via movement of these two parts relative to each other, for a clamping force to be exerted using simple design.

In order to adjust and fix the relative position between the connecting element and the holding foot, the clamping element advantageously comprises a setting device. By this setting device, a clamping force can then be specifically exerted on the musical instrument via the clamping element in order to thus clamp the chin support with the musical instrument via the holding foot of the one or more clamping elements.

In an embodiment of particularly simple design, the setting device comprises a screwed connection. In terms of manufacture, it is then particularly easy for the clamping element to comprise a mating receptacle for the screwed connection. This provides a simple way of accomplishing relative movement between the connecting element and the holding foot and hence a good clamping action between the musical instrument and the chin support.

It is particularly advantageous for the mating receptacle to have arranged therein a screw nut in rotationally fixed relation thereto. The need for threaded bores in the clamping element can thus be eliminated, and the choice of materials is not limited thereby. Furthermore, the setting device can then be configured with few parts, i.e. essentially two, namely the set screw and the associated screw nut.

The mating receptacle is advantageously arranged in the connecting element. Thus, by actuation of the screw from the underside of the musical instrument, the chin rest can then be clamped with the musical instrument.

It is particularly advantageous for the screwed connection to be arranged within the clamping element. Thus, the metallic screw is surrounded by or embedded in the material of the clamping element which is chosen to be a skin-friendly material, and the player of the musical instrument having the chin rest held thereon does not come into contact with the metal material of the screw.

In order to provide a simple way of ensuring good displacement capability between the connecting element and the holding foot, the connecting element advantageously comprises a displacement guide for the holding foot.

The connecting element advantageously comprises a holding head whose configuration is adapted to that of the insertion guide. A secure hold of the chin rest constructed in accordance with the invention on the musical instrument can thereby be achieved.

To this end, in a variant of an embodiment, the holding head comprises a guide web which is adapted to a guide channel of the insertion guide. This provides for good insertion of the clamping element into the insertion guide and secure hold.

To achieve a large holding area, the guide web is advantageously arranged on the holding head so as to extend laterally outwardly therefrom. Furthermore, the holding head advantageously comprises a contact face for contact with a corresponding contact face of a support channel of the insertion guide. In this way, the clamping force can be well absorbed by the insertion guide via the holding head and there is a reliable and stable hold.

In particular, in order to enable the holding head to be manufactured using an injection moulding process, the holding head has an essentially U-shaped profile at the end thereof that is provided for insertion into the insertion guide. Tooth-shaped profiles or similar profiles may also be provided. On the one hand, a good hold is thereby achieved as the holding head is of non-solid configuration and corresponding inner faces can also contribute to the hold, and on the other hand, this configuration lends itself well to injection moulding processes.

Advantageously, guide webs are formed at the sides of the end that is provided for insertion into the insertion guide. These strengthen the hold by augmenting the holding area.

In a particularly advantageous embodiment, those parts of a clamping element which may come into contact with the player's skin when the musical instrument is gripped by way of the chin rest are made of a skin-friendly material and are made in particular of a skin-friendly plastics material. Direct contact between skin and metal is thereby avoided, and the chin rest constructed in accordance with the invention can also be used by persons who have metal allergies, and the risk of metal allergies developing is reduced.

Advantageously, the connecting element is made in its entirety of a plastics material and the holding foot is also made of a plastics material.

In order to enable the connecting element to be manufactured cost-effectively by an injection moulding process, a holding head of the clamping element is advantageously configured such that the walls forming it have essentially the same wall thickness.

To this end, the holding head advantageously comprises a central recess, whereby on the one hand, uniform wall thicknesses are achieved and, on the other hand, the holding area is increased.

In an advantageous variant of an embodiment, the holding device comprises two clamping elements. By the provision of two clamping elements, the chin support is reliably held on the musical instrument and the number of parts that are to be provided for the holding device is small. Accordingly, two insertion guides arranged in spaced relation to each other are then to be provided for receiving the two clamping elements.

It is particularly advantageous for the at least one support foot to be lockably rotatably and/or swivelably and/or tiltably fixable to the chin support. With the solution in accordance with the invention it is possible, where a plurality of support feet exist, to use support feet of differing height. A tilt of the chin support with respect to the top of the musical instrument can thereby be adjusted. By a rotating capability, swiveling capability or tilting capability of a support foot for fixation to the chin support, it is possible to achieve that, where a plurality of support feet exist, the corresponding support faces can be oriented in one plane even if the support feet have different heights.

In an embodiment, the chin support comprises a first circular arc element which comprises a first circular arc area and on which the at least one support foot supports itself with a second circular arc element via a second circular arc area thereof. A kind of orbital rotational bearing is thereby provided, affording support even if the corresponding support foot is adjusted to a tilt position on the chin support. This in turn makes it possible to achieve a planar contact face of the sum of all support feet against the top of the musical instrument, wherein support feet of differing height can be used.

In particular, one of the circular arc areas (out of the set of the first circular arc area and the second circular arc area) has a concave shape, while the other circular arc area (out of that set) has a convex shape to conform to said concave shape.

It is further advantageous for the at least one support foot to comprise one or more support elements which support themselves on a side that is oriented transversely to a support face in a clamping direction. The support face in the clamping direction is the main support face when the chin rest is clamped to the musical instrument. Said support face is for example formed by a circular arc area. By the one or more support elements, an additional transverse support (lateral support) is provided, by which the stability is increased. The one or more support elements can be easily arranged and configured such that the support effect is achieved independently of the rotational position or tilt position of the corresponding support foot.

In particular, at least a first support element and a second support element are provided, with an interspace lying therebetween. The support foot can then be placed over the interspace, and a fixing sleeve, in particular for a screw, for fixing the at least one support foot to the chin support can then be positioned in the interspace.

Advantageously, when the at least one support foot is fixed, at least one fixing sleeve of the chin support is positioned in the interspace. The fixing sleeve can receive a screw. It is for example cylindrical in the manner of a column.

It is advantageous for the chin support to have sitting thereat, in associated relation with the at least one support foot, at least one fixing sleeve which is in particular provided with a thread. The fixing sleeve is for example configured as a column. It is then possible for a screw to engage the fixing sleeve in order to provide fixation of the at least one support foot to the chin support.

In particular, the at least one fixing sleeve is oriented at an acute angle to a surface of the chin support, wherein the acute angle is in particular in the range between 30° and 60°. Optimized space conditions can thereby be provided. The fixing sleeve can be positioned such that, on the one hand, it does not mar the aesthetic overall impression of the external appearance of the fixed chin rest. On the other hand, the fixing area for fixing the at least one support foot to the chin support can thereby be separate from a fixing area for fixing the holding device to the chin support.

In particular, the at least one fixing sleeve faces inwardly and away from an outer edge of the chin support. The at least one fixing sleeve then projects, in the manner of a column, in an upward direction at an angle from the rear, without protruding beyond the outer edge of the chin support but, as noted above, pointing inwardly. This results in optimized space conditions.

In a simple embodiment in terms of manufacture, the at least one support foot is releasably fixed or fixable to the chin support by having one or more screws engage the at least one fixing sleeve. By loosening a screw, a corresponding support foot can be replaced in a simple manner.

It is advantageous for the at least one support foot to have a padding arranged on a support face against the musical instrument. In this way, the musical instrument is protected from being scratched or damaged otherwise.

In particular, different support feet differ in their height between a support face against the musical instrument and a support face against the chin support and/or in the manner of fixing the holding device. It is thereby possible, by selecting appropriate support feet, to adjust the relative position of the chin support both in terms of height and in terms of tilt relative to the top of the musical instrument and/or to adjust the type of holding device with which the chin support is intended to be used.

In accordance with the invention, a chin rest system is provided which comprises a chin rest constructed in accordance with the invention and a set of support feet, wherein the set of support feet comprises at least two different support feet. It is thereby possible for the chin rest to be easily adapted to suit the requirements of a specific individual.

A musical instrument constructed in accordance with the invention is provided with a chin rest constructed in accordance with the invention.

The following description of preferred embodiments serves to explain the invention in greater detail in conjunction with the drawings.

BRIEF DESCRIPTION OF THE DRAWINGS

FIG. 5(*b*) is the same view as FIG. 5(*a*), the chin support having other support feet fixed thereto;

FIG. 5(*c*) is the same view as FIG. 5(*a*), the chin support having yet other support feet mounted thereon;

FIG. 5(*d*) is the same view as FIG. 5(*a*), the chin support having still other support feet fixed thereto;

DETAILED DESCRIPTION OF THE INVENTION

Figure 1:
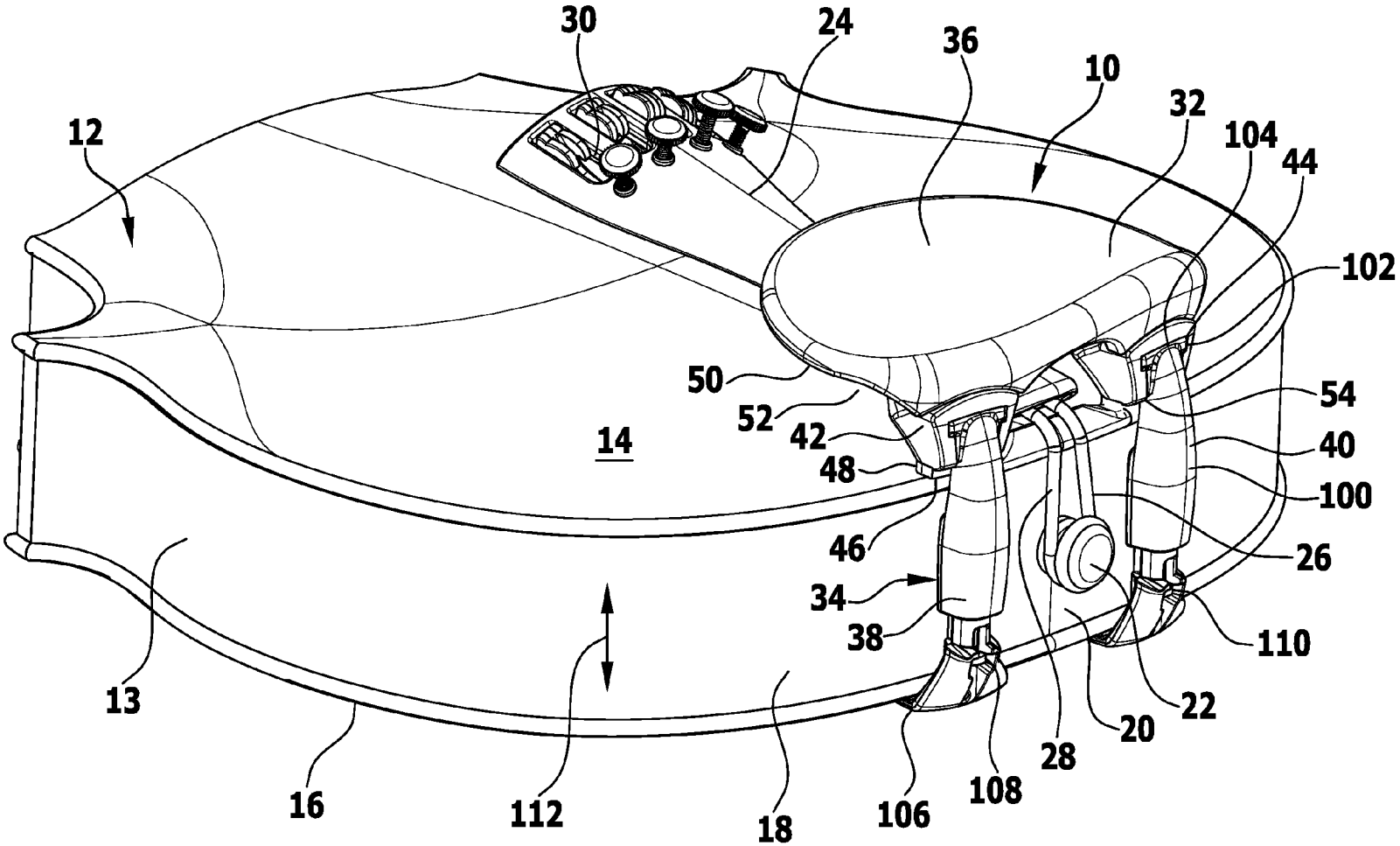
FIG. 1 is a perspective partial view of a musical instrument (violin) to which is fixed a first exemplary embodiment of a chin rest constructed in accordance with the invention.

An exemplary embodiment of a chin rest constructed in accordance with the invention, shown in FIG. 1 and indicated therein at 10, is (releasably) fixed to a violin 12 as a musical instrument. The violin 12 has a corpus 13 which comprises a top 14 having arranged thereon a bridge (not shown in the drawing). The corpus 13 comprises a back 16 which is arranged on the opposite side of the top 14. Interposed between the top 14 and the back 16 is a rib 18.

Arranged at the rib 18, particularly in a rear crown area 20 thereof, is an end button 22. A tailpiece 24 can be anchored to the end button 22 by way of a tailpiece hanger 26 (tailgut), forming a loop 28. The tailpiece 24 in turn holds a plurality of strings (four in the case of a violin as an example), in particular by way of fine tuners 30. In the area of the other end, the strings are fixed to the neck of the violin by way of corresponding pegs.

The chin rest 10 comprises a chin support 32 and a holding device 34. By way of the holding device 34, the chin support 32 can be fixed to the corpus 13 of the violin 12. The chin support 32 is designed for contact with the musician's face.

The chin support 32 has a surface 36 which, with the chin rest 10 fixed to the violin 12, faces away from the top 14. Said surface 36 of the chin support 32 conforms to the anatomy of the face.

The holding device 34 of the chin rest 10 comprises a first clamping element 38 and a second clamping element 40. The first clamping element 38 and the second clamping element 40 are held in spaced relation to each other on the chin support 32. In principle, the first clamping element 38 and the second clamping element 40 are of identical configuration.

Arranged on the chin support are a first support foot 42 and a second support foot 44. Each of these has a support face 46. Arranged on the support face 46 is a pad 48 which may for example be a cork element. By way of the support face 46 of the first support foot 42 and of the second support foot 44, the chin rest 10 supports itself on the top 14 of the musical instrument 12, namely on an edge region of the top 14 in a direction towards the rib 18.

The first support foot 42 and the second support foot 44 are releasably fixed to the chin support 32 and are thereby replaceable, as will be explained in greater detail below.

The chin support 32 has a back side 50 opposite the surface 36. With the chin rest 10 fixed to the musical instrument 12, the back side 50 faces towards the top 14, while being in spaced relation thereto. A free space 52 is formed between the chin support 32 having the back side 50, the top 14 of the musical instrument and the support feet 42, 44.

The first support foot 42 and the second support foot 44 are spaced apart from each other. They have an interspace 54 therebetween. The interspace 54 is open to the free space 52, i.e. it communicates therewith.

The chin rest 10 can thereby be mounted over the tailpiece 24; the tailpiece 24 is located with a portion thereof within the free space 52. The interspace 54 has the tailpiece hanger 26 extending therethrough so that the latter can be fixed to the end button 22.

The first support foot 42 and the second support foot 44 are releasably fixed to the back side 50 of the chin support 32.

The chin support 32 comprises, in a rear area 56 thereof and in a direction towards its back side 50, a raised edge region 58. The raised edge region comprises a first circular arc element 60 which is associated with the first support foot 42. The first circular arc element 60 defines a concave circular arc area 62 which faces away from the surface 36. The concave circular arc area 62 forms a support face for fixing the first support foot 42 to the chin support 32.

Sitting at the chin support 32 is a further first circular arc element 64 which is associated with the second support foot 44. The further first circular arc element 64 also has a concave circular arc area 62 for providing support for the second support foot 44.

The first circular arc element 60 and the further first circular arc element 64 are in particular formed in one piece with the chin support 32.

The first circular arc element 60 and the further first circular arc element 64 are spaced apart from each other, for example with an arc-shaped recess 66 therebetween. Said recess 66 forms part of the interspace 54.

Sitting at the respective first circular arc elements 60, 64 is a column-like sleeve 68 which is in particular of cylindrical configuration. In particular, the sleeve 68 is arranged about centrally relative to the circular arc area 62. The sleeve 68 is provided with an internal thread 70.

The sleeve 68 is oriented at an acute angle 72 relative to the surface 36 or the back side 50. Said acute angle is for example in the range between 30° and 60°. In an exemplary embodiment, said acute angle 72 is about 45°.

The first circular arc elements 60 and 64 each have a wall 74 having the concave circular arc area 62 formed thereon. Said wall 74 has a side 76 that is oriented transversely relative to the concave circular arc area 62. Sitting at said side 76 is the sleeve 68, protruding therefrom in an upward direction at an angle pointing away from the rear area 56 of the chin support 32 and towards a front area 78. When the chin rest 10 is mounted to the violin 12, then the front area 78 faces towards the bridge.

The sleeve 68 subdivides an area of the side 76 into a first partial area 80*a* and a second partial area 80*b*. The side 76 forms a support face for support elements of the respective support feet 42 and 44, as will be more fully described below.

The support feet 42 and 44 each comprise a second circular arc element 82 which defines a convex circular arc area 84. By way of the circular arc area 84, the corresponding support foot (for example the first support foot 42) is supported at the associated concave circular arc area 62 of the first circular arc element 60 of the chin support 32.

Furthermore, the first support foot 42 and the second support foot 44 each have support elements 86*a*, 86*b* that are spaced apart from each other. Said support elements 86*a*, 86*b* are configured such that they can provide support at the side 76. The support element 86*a* is provided for support at the second partial area 80*b* and the support element 86*b* is provided for support at the first partial area 80*a*. By the support elements 86*a*, 86*b* being spaced apart from each other, it is possible for the sleeve 68 to pass through the corresponding interspace.

The first support foot 42 and the second support foot 44 each have an opening 88 therethrough, said opening 88 having an enlargement 90 in a direction towards a surface thereof. A screw 92 can be passed through the opening 88, said screw 92 being capable of engaging with the internal thread 70 of the sleeve 68. The enlargement 90 serves to receive a screw head 94 in order to have it countersunk so that it will not protrude beyond the surface of the corresponding support foot 42, 44.

The opening 88 and the enlargement 90 are configured such that a rotational (tilt, swivel) position of the corresponding support foot 42, 44 relative to the chin support 32 is lockably adjustable. By the contact of the circular arc areas 84 and 62 with each other, a kind of orbital rolling of the corresponding first support foot 42 on the chin support 32 can be effected. By locking via the screw 92, a corresponding rotational position (tilt position, swivel position) can thereby be adjusted. This tilt position in turn determines the orientation of the corresponding support face 46 of the corresponding support foot 42, 44. It is thereby possible, as will be explained more fully hereinafter, to achieve a planar support face as the sum of the support faces 46 of the first support foot 42 and of the second support foot 44, even if the two support feet 42, 44 have different configurations.

The second circular arc element 82 of the corresponding support foot 42, 44 is connected, and is in particular integrally connected, to a nose element 96. Sitting at the nose element 96 is the opening 88 comprising the enlargement 90. When the corresponding support foot 42, 44 is fixed to the chin support 32, the nose element 96 projects away from the rear area 56 and towards the front area 78. The nose element 96 has an inclined surface 98.

The nose element 96 has sitting thereon the pad 48 and has therefore formed thereon the support face 46.

The holding device 34 is releasably fixable or fixed to the support feet 42, 44. The first clamping element 38 is capable of being fixed to the first support foot 42 and the second clamping element 40 is capable of being fixed to the second support foot 44.

In an exemplary embodiment, the holding device 34 is configured in the same way as described in EP 1 067 508 A2, or U.S. Pat. No. 6,268,555 B1, which is incorporated herein and made a part hereof by reference in its entirety and for all purposes. The first clamping element 38 and the second clamping element 40 each comprise a connecting element 100 having a holding head 102 formed thereon, in particular integrally formed thereon (compare FIG. 1). An insertion guide 104 is formed on the respective support feet 42, 44. The holding head 102 can be inserted into the insertion guide 104. The clamping elements 38 and 40 can thereby be affixed to the support feet 42 and 44 respectively, associated therewith.

Furthermore, the clamping elements 38 and 40 each comprise a holding foot 106 having an L-shaped profile. The holding foot 106 provides a contact face for contact with the back 16 and the rib 18. Said contact face is provided with a corresponding padding, which may for example be a cork element.

The holding foot 106 is guided by way of a displacement guide 108 for lockable displacement on the connecting element 100. The relative position between the connecting element 100 and the holding foot 106 can be fixed by way of a setting device 110. The setting device comprises for example a set screw arranged in a longitudinal direction of the connecting element 100. A screw head of said set screw is accessible from the end of the holding foot 106.

For further details in particular with respect to the displacement guide 108 and the setting device 110, reference is made to EP 1 067 508 A2, or U.S. Pat. No. 6,268,555 B1. This document is incorporated herein and made a part hereof by reference in its entirety and for all purposes.

By way of the holding device 34, the chin rest 10 can be clamped to the corpus 13 of the musical instrument 12. Corresponding opposing clamping faces are the support faces 46 of the first support foot 42 and of the second support foot 44 for contact with the top 14 and corresponding contact faces of the holding feet 106 of the first clamping element 38 and of the second clamping element 40 which are brought into contact with the back 16. A clamping direction 112 is at least approximately a direction of the distance between the back 16 and the top 14, if positioned correctly.

The holding device 34 is configured such that the chin rest 10 is releasable. By releasing the setting device 110, it is possible to release the clamping action and the contact between the holding foot 106 and the back 16 can be released. This then enables the chin rest 10 to be removed from the musical instrument 12.

Figure 2:
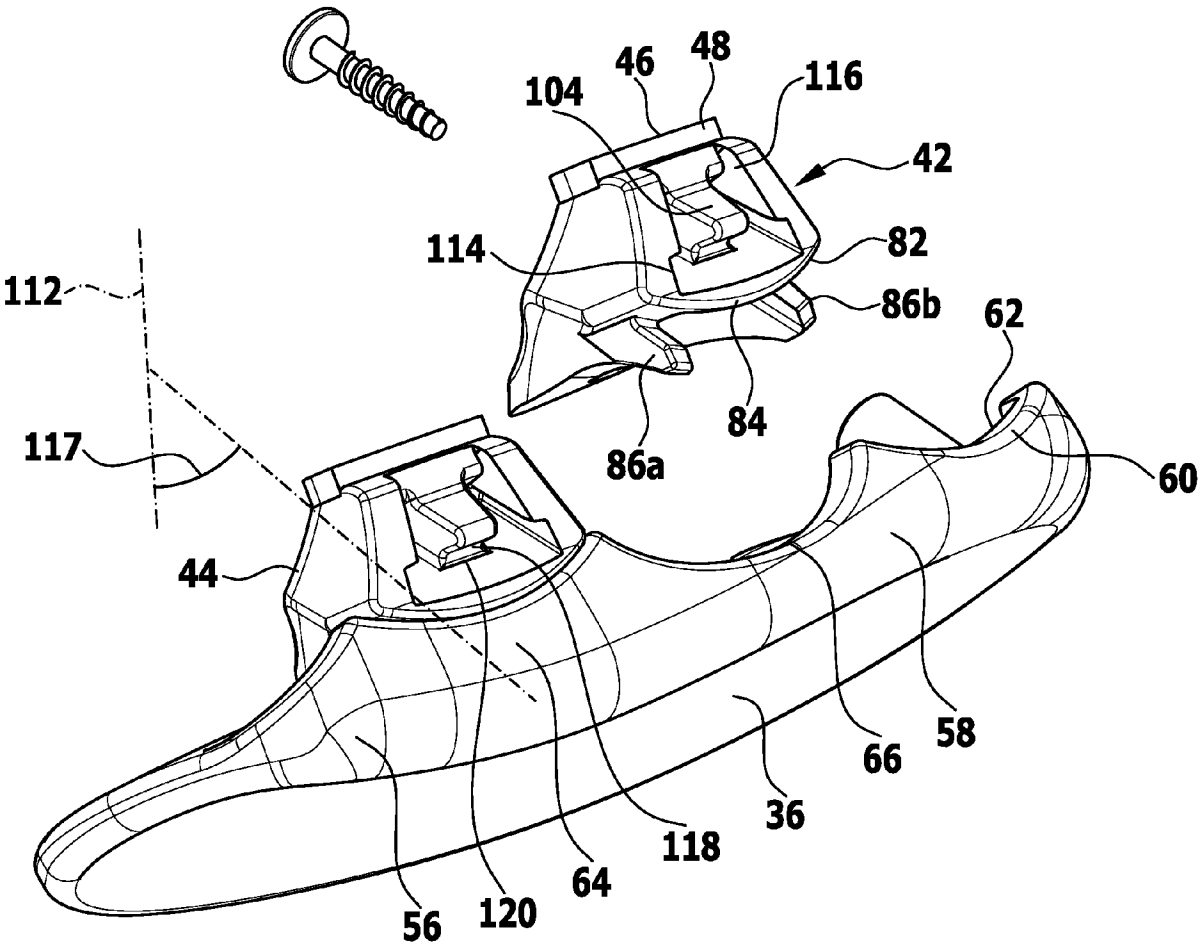
FIG. 2 is a chin support of the chin rest in accordance with FIG. 1, comprising a first support foot shown as sitting at the chin support and a second support foot shown as released from the chin support.
Figure 3:
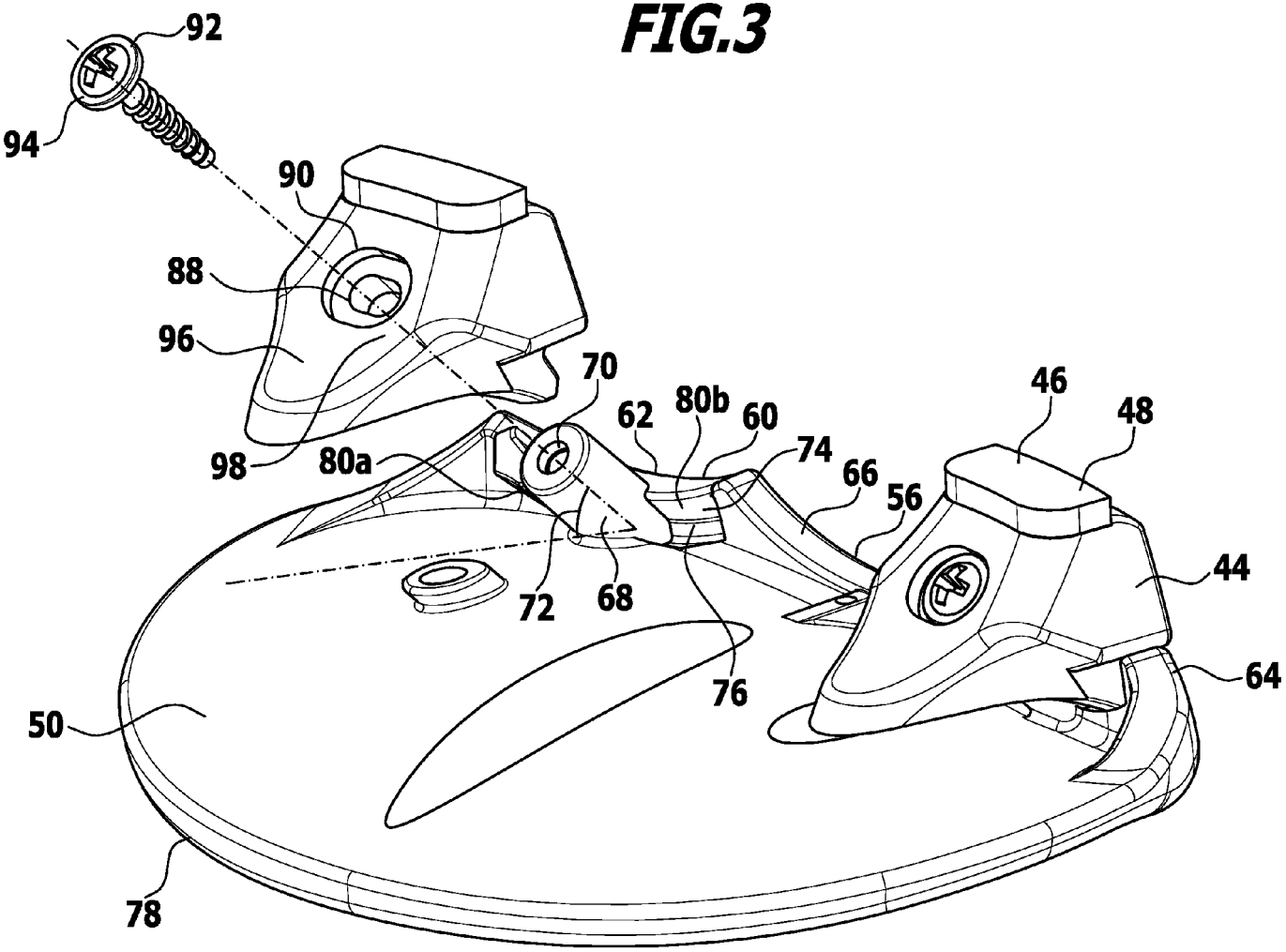
FIG. 3 is a different view of the chin support in accordance with FIG. 2.

The insertion guide 104 formed at the corresponding support foot 42, 44 is formed by a recess 114 provided in the corresponding support foot 42, 44. The recess 114 comprises a guide channel 116 (compare FIG. 2) which is oriented at an incline to the clamping direction 112. A corresponding angle 117 is for example in the range between 20° and 70° and is preferably between 35° and 55°. In a preferred embodiment, said angle 117 is in the range of about 45°.

The insertion guide 104 further comprises a support channel 118 which communicates with the guide channel 116. The support channel 118 defines a contact face 120. The contact face 120 is arranged transversely and in particular at least about perpendicularly to the clamping direction 112. The contact face 120 is oriented at least about parallel to the support face of the corresponding support foot 42, 44. It serves to provide support for the holding head 102 when the latter is inserted in the recess 114 when the chin support 32 is clamped with the musical instrument 12 via the clamping elements 38, 40. The guide channel 116 is of wider configuration than that of the support channel 118 in a direction perpendicular to the clamping direction 112.

The holding head 102 of the respective clamping elements 38, 40 is adapted to the corresponding insertion guide 104. To this end, it comprises for example at its upper end guide webs which are arranged at the acute angle 117 relative to the longitudinal direction of the connecting element 100. The guide webs are intended to be inserted into the guide channels 116 of the insertion guide 104. For adaptation to the insertion guide 104, the guide webs are arranged on the holding head 102 so as to project laterally outwardly therefrom.

With respect to the further configuration of the holding head 102, reference is made to EP 1 067 508 A2, or U.S. Pat. No. 6,268,555 B1. This document is incorporated herein and made a part hereof by reference in its entirety and for all purposes.

With the solution in accordance with the invention, the support feet 42, 44 can be released from the chin support 32 and are therefore replaceable. Adaptation to suit individual user requirements is thereby possible.

Figure 4:
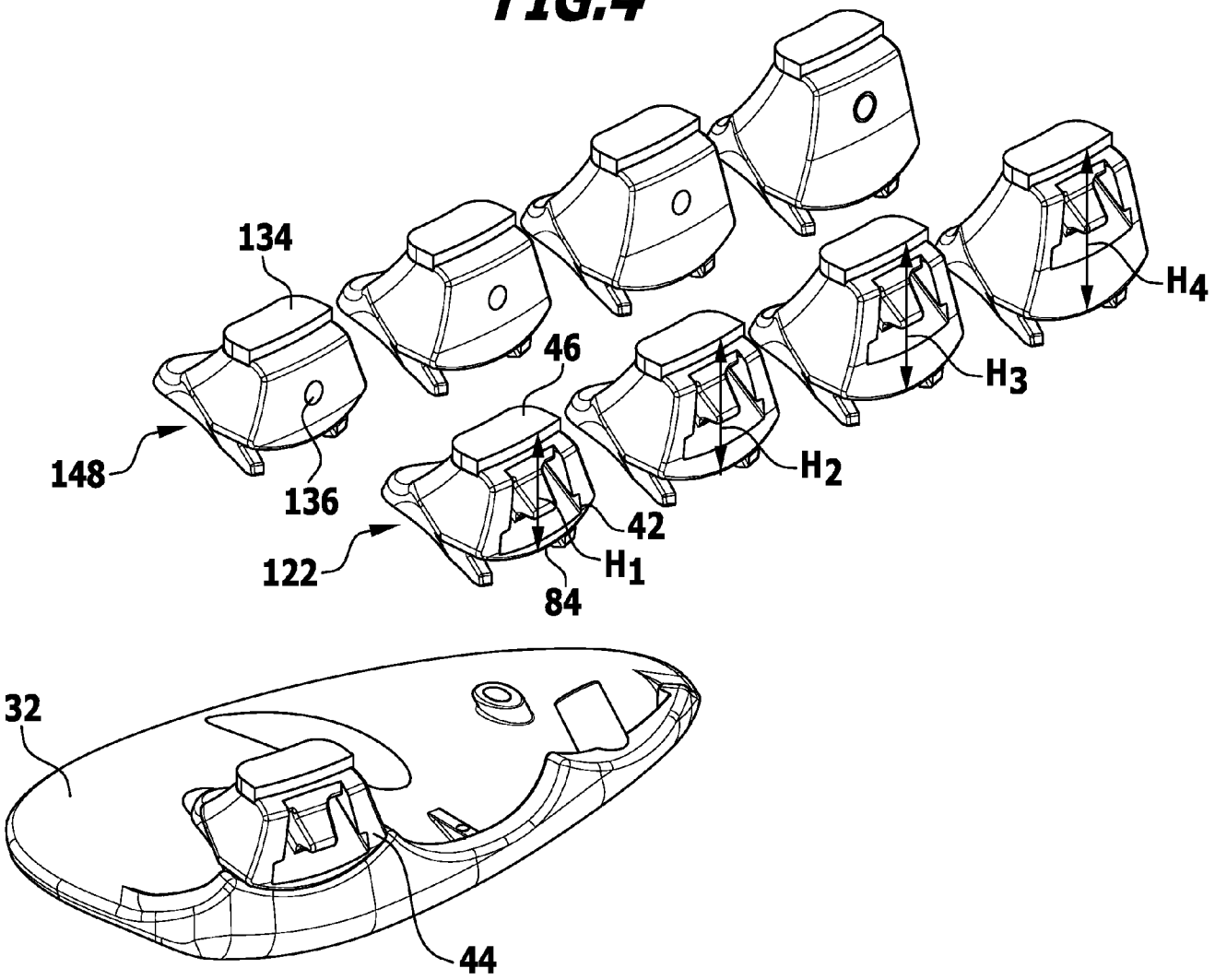
FIG. 4 shows the chin support in accordance with FIG. 2, comprising a first set of support feet and a second set of support feet.
Figure 5A:
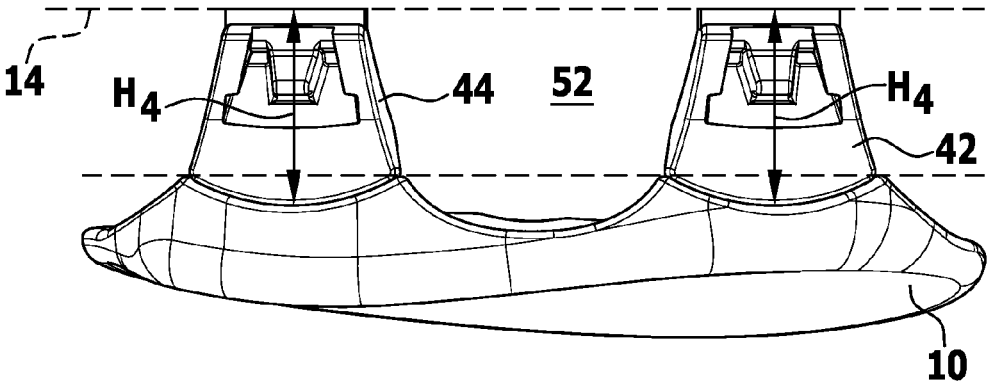
FIG. 5(*a*) illustrates a front view of the chin support in accordance with FIG. 2, shown as having fixed thereto a first exemplary embodiment of support feet.
Figure 5B:
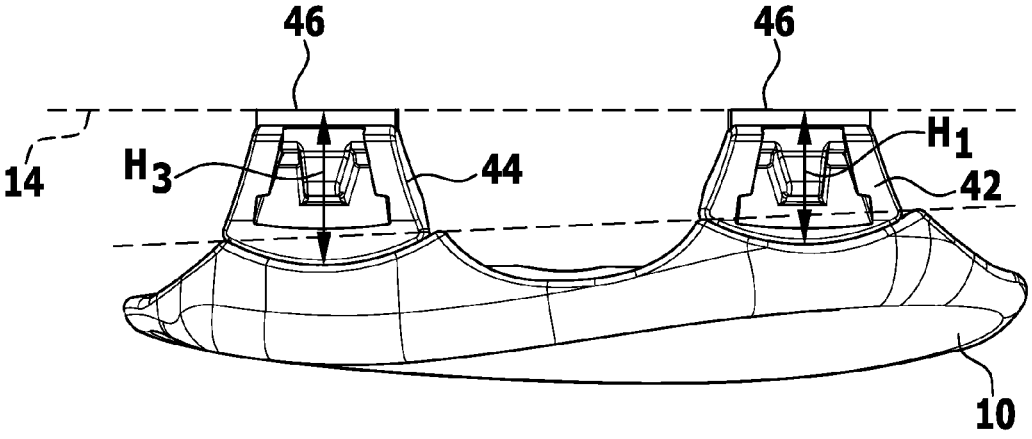
Figure 5C:
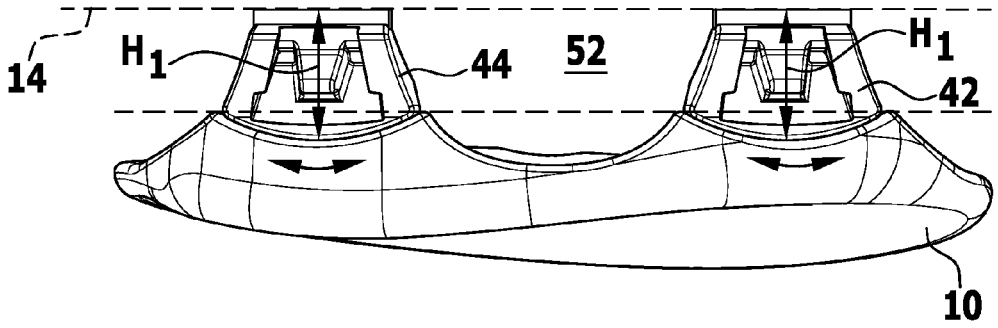
Figure 5D:
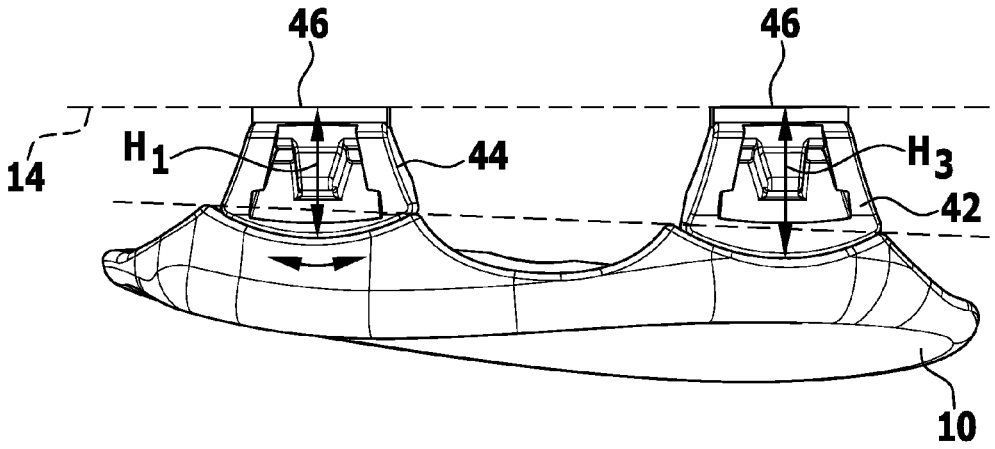

In particular, in accordance with the invention, a chin rest system is provided comprising the chin rest 10 and a set 122 of support feet (compare FIG. 4). Support feet 42 and 44 each have a certain height H between their support face 46 and their support face against the chin support 32, namely the circular arc area 84. Said height H then also determines the distance of the fixed chin support 32 from the top 14 and determines the configuration of the free space 52.

Different support feet can have different heights $H_1$, $H_2$, $H_3$, $H_4$, as demonstrated in FIG. 4 by the example of the set 122. The chin rest 10 can thereby be adapted to suit individual requirements.

This is shown schematically in FIGS. 5(*a*) to (*d*). In the exemplary embodiment in accordance with FIG. 5(*a*), a first support foot 42 and a second support foot 44 are provided, each having a height $H_4$. In comparison therewith, the exemplary embodiment in accordance with FIG. 5(*c*) provides for support feet having a smaller height, $H_1$. In the exemplary embodiment according to FIG. 5(*a*), the surface 36 of the chin support 32 then has a distance from the top 14 that is greater than that of the exemplary embodiment in accordance with FIG. 5(*c*). The releasability of the support feet 42, 44 provides a simple way of converting the embodiment in accordance with FIG. 5(*a*) to the embodiment in accordance with FIG. 5(*c*) and vice versa by replacing the support feet 42, 44.

It is in principle possible to use support feet that are of the same configuration, as is the case in the embodiments in accordance with FIGS. 5(*a*) and 5(*c*). Further, a corresponding tilt position of the chin support 32 with respect to the top 14 can be achieved if support feet 42, 44 of differing height H are used. This is indicated in FIGS. 5(*b*) and (*d*). In the example of FIG. 5(*b*), the first support foot 42 has a height $H_1$ and the second support foot 44 has a height $H_3$, wherein $H_3$ is greater than $H_1$.

By a corresponding tilt adjustment of the first support foot 42 and/or of the second support foot 44 when supported against the chin support 32, it is possible to achieve that the support faces 46 of the first support foot 42 and of the second support foot 44 lie in one plane. By supporting the circular arc areas 62, 84 against each other, the corresponding positioning of the first support foot 42 and/or of the second support foot 44 can be achieved, even if these have different heights H. In the exemplary embodiment in accordance with FIG. 5(*b*), the first support foot 42 is rotated in order for this planar orientation of the support faces 46 to be achieved. This lockable rotation (tilt) is in turn achieved by having the first circular arc element 60 and the second circular arc element 82 roll correspondingly upon one another.

FIG. 5(*d*) depicts a situation similar to the one illustrated in FIG. 5(*b*), only that the first support foot 42 is shown to have a height $H_3$ and the second support foot 44 is shown to have a height $H_1$. In order for the support faces 46 to lie in one plane, the second support foot 44 is tilted by a corresponding rolling-contact motion.

Figure 6:
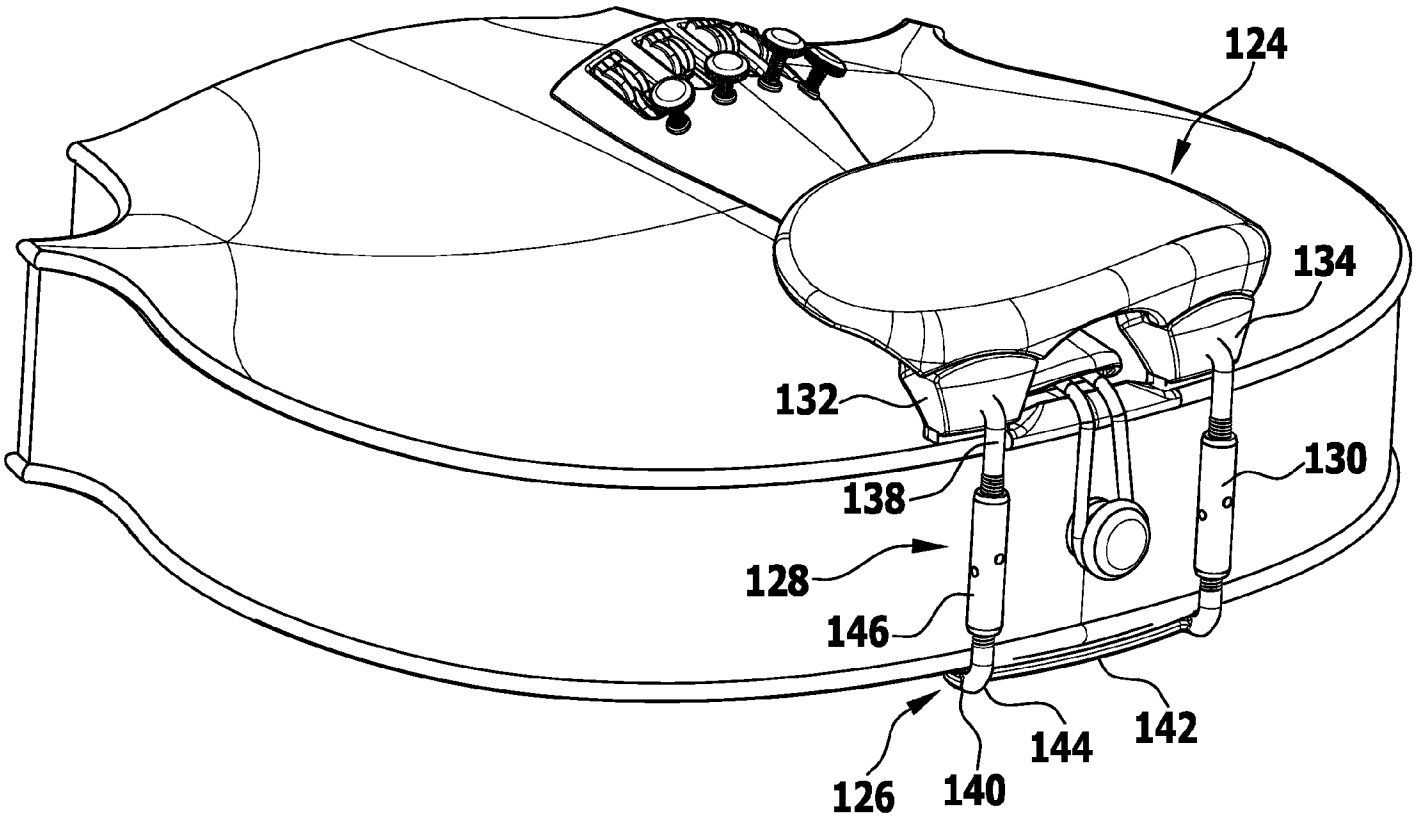
FIG. 6 illustrates a perspective partial view of a musical instrument to which is fixed another exemplary embodiment of a chin rest.

In a further embodiment of a chin rest constructed in accordance with the invention, which is shown schematically in FIG. 6 and indicated therein at 124, a holding device 126 is provided which comprises a first clamping element 128 and a second clamping element 130. The first clamping element 128 is fixed at a first support foot 132, and the second clamping element is fixed at a second support foot 134. The support feet 132, 134 each have arranged thereat a recess by way of which the clamping elements 128 and 130 respectively are fixed. The recess is for example provided with a thread, and a pin element 138 can be threaded into the recess.

Furthermore, the first clamping element 128 and the second clamping element 130 each comprise a holding foot 140. Provision may be made for the holding feet 140 of the first clamping element 128 and of the second clamping element 130 to be connected by way of a web 142. The web 142 may itself be part of the holding feet 140 in order, for example, to increase the contact face against the musical instrument 12.

The pin element 138 is provided with an external thread. Furthermore, a pin element 144 that is connected to the holding foot 140 is provided with an external thread. These two external threads are of opposite pitch. A union nut 146 is screwed onto the threads of the respective pin elements 138 and 144 comprising internal threads of opposite pitch. It is thereby possible to create a clamping force in order to urge chin support with the support feet 132, 134 against the corpus 13 of the musical instrument 12.

Otherwise, the support feet 132, 134 are configured as described above. In particular, a set 148 (compare FIG. 4) of support feet having different heights H is provided.

In the solution in accordance with the invention, the chin support (chin rest cup) and the support feet 42, 44 are separate components. It is thereby possible to adapt the chin rest 10 variably to the individual needs of a particular user. Support feet 42, 44 with different heights H can be fixed in order to thus provide ergonomic adaptation to the needs of each user. This adaption itself is in turn variable so that the chin rest 10 can for example be adjusted in order to adapt to changes in the physical dimensions of the musician (in particular, it can allow for the changing requirements of a growing child).

It is also possible to mount support feet 42, 44 of differing height in order to achieve a lateral tilt of the chin support 32 and thus allow for optimized adaptation.

Also, a user can easily experiment with different positions of the chin support 32 relative to the musical instrument 12 without needing a plurality of complete chin rests.

Furthermore, inventory reduction for different models is possible.

In principle, a user can also easily replace the holding device, for example by switching from set 122 support feet to set 148 support feet and vice versa.

Furthermore, by way of the interspace 54, the chin rest 10 constructed in accordance with the invention can in particular be mounted so as to be centred over a tailpiece 24.

LIST OF REFERENCE CHARACTERS

10 chin rest (first exemplary embodiment)
12 violin
13 corpus
14 top
16 back
18 rib
20 crown area
22 end button
24 tailpiece
26 tailpiece hanger
28 loop
30 fine tuners
32 chin support
34 holding device
36 surface
38 first clamping element
40 second clamping element
42 first support foot
44 second support foot
46 support face
48 pad
50 back side
52 free space
54 interspace
56 rear area
58 raised edge region
60 first circular arc element
62 concave circular arc area
64 further first circular arc element
66 recess
68 sleeve
70 internal thread
72 acute angle
74 wall
76 side
78 front area
80*a* first partial area
80*b* second partial area
82 second circular arc element
84 convex circular arc area
86*a, b* support elements
88 opening
90 enlargement
92 screw
94 screw head
96 nose element
98 inclined surface
100 connecting element
102 holding head
104 insertion guide
106 holding foot
108 displacement guide
110 setting device
112 clamping direction
114 recess
116 guide channel
117 acute angle
118 support channel
120 contact face
122 set
124 chin rest (second exemplary embodiment)
126 holding device
128 first clamping element
130 second clamping element
132 first support foot
134 second support foot
138 pin element
140 holding foot
142 web
144 pin element
146 union nut
148 set

The invention claimed is:

1. Chin rest for a musical instrument, comprising:
a chin support;
a holding device for holding the chin support on the musical instrument; and
at least one support foot which supports the chin support on a top of the musical instrument;
wherein:
the at least one support foot is releasably arranged on the chin support,
the at least one support foot is at least one of (i) lockably rotatably, (ii) lockably swivelably and (iii) lockably tiltably fixable to the chin support,
the chin support comprises a first circular arc element which forms a first circular arc area, and
the at least one support foot comprises a second circular arc element which forms a second circular arc area which is supported on the first circular arc area.

2. Chin rest in accordance with claim 1, wherein:
the holding device comprises at least one holding foot which is provided for support against a back of the musical instrument opposite the top,
the chin rest is clampable, by way of the holding device, to the musical instrument between the top and the back thereof.

3. Chin rest in accordance with claim 1, wherein the at least one support foot is provided for support on a rim region of the top of the musical instrument in a direction towards a rib of the musical instrument.

4. Chin rest in accordance with claim 1, wherein, with the chin rest fixed to the musical instrument, a free space for a tailpiece is formed between the chin support, the at least one support foot and the top of the musical instrument.

5. Chin rest in accordance with claim 1, wherein the at least one support foot is arranged at or in a vicinity of an outer edge of the chin support.

6. Chin rest in accordance with claim 1, wherein the at least one support foot comprises at least a first support foot and a second support foot.

7. Chin rest in accordance with claim 6, wherein the first support foot and the second support foot are spaced apart from each other, with an interspace lying between the first support foot and the second support foot.

8. Chin rest in accordance with claim 7, wherein the interspace communicates with a free space between the chin support and the top of the musical instrument when the chin rest is fixed to the musical instrument.

9. Chin rest in accordance with claim 1, wherein the holding device is fixed or fixable to the at least one support foot.

10. Chin rest in accordance with claim 9, wherein the at least one support foot comprises at least one insertion guide which is arranged and configured such that an associated clamping element of the holding device is insertable into the insertion guide in an inserting direction that is at an incline to a clamping direction.

11. Chin rest in accordance with claim 10, wherein the at least one insertion guide is formed by at least one channel in the at least one support foot.

12. Chin rest in accordance with claim 1, wherein one of the first and second circular arc areas has a concave shape, the other of the first and second circular arc areas having a convex shape which conforms to said concave shape.

13. Chin rest in accordance with claim 1, wherein the at least one support foot comprises one or more support elements which provide support for the at least one support foot on a side of the chin support that is oriented transversely to a support face of the at least one support foot in a clamping direction.

14. Chin rest in accordance with claim 13, wherein the one or more support elements comprises at least a first support element and a second support element, with an interspace lying between the first support element and the second support element.

15. Chin rest in accordance with claim 14, wherein, when the at least one support foot is fixed, at least one fixing sleeve of the chin support is positioned in the interspace.

16. Chin rest in accordance with claim 1, wherein the chin support comprises at least one fixing sleeve associated with the at least one support foot.

17. Chin rest in accordance with claim 16, wherein the at least one fixing sleeve is oriented at an acute angle relative to a surface of the chin support.

18. Chin rest in accordance with claim 17, wherein the at least one fixing sleeve is oriented inwardly and away from an outer edge of the chin support.

19. Chin rest in accordance with claim 16, wherein the at least one support foot is releasably fixed or fixable to the chin support by one or more screws engaging with the at least one fixing sleeve.

20. Chin rest in accordance with claim 1, wherein the at least one support foot has a padding arranged on a support face which engages against the musical instrument.

21. Chin rest in accordance with claim 1, wherein the at least one support foot comprises two different support feet which differ in at least one of: a height between a support face which engages against the musical instrument and a support face which engages against the chin support; and a manner of fixing the holding device.

22. Chin rest system, comprising a chin rest for a musical instrument, said chin rest comprising:

a chin support;

a holding device for holding the chin support on the musical instrument;

at least two different support feet which support the chin support on a top of the musical instrument;

wherein:

the at least two different support feet are releasably arranged on the chin support;

the at least two different support feet are each at least one of (i) lockably rotatably, (ii) lockably swivelably and (iii) lockably tiltably fixable to the chin support, the chin support comprises at least two first circular arc elements which form respective first circular arc area, and the at least two different support feet each comprise a second circular arc element which forms a second circular arc area which are supported respectively on a corresponding one of the first circular arc areas.

23. Musical instrument, provided with a chin rest, comprising:

a chin support;

a holding device for holding the chin support on the musical instrument; and at least one support foot which supports the chin support on a top of the musical instrument;

wherein:

the at least one support foot is releasably arranged on the chin support, the at least one support foot is at least one of (i) lockably rotatably, (ii) lockably swivelably and (iii) lockably tiltably fixable to the chin support, the chin support comprises a first circular arc element which forms a first circular arc area, and the at least one support foot comprises a second circular arc element which forms a second circular arc area which is supported on the first circular arc area.

24. Chin rest for a musical instrument, comprising:

a chin support;

a holding device for holding the chin support on the musical instrument; and at least one support foot which supports the chin support on a top of the musical instrument;

wherein:

the at least one support foot is releasably arranged on the chin support, the holding device is fixed or fixable to the at least one support foot, and the at least one support foot comprises at least one insertion guide which is arranged and configured such that an associated clamping element of the holding device is insertable into the insertion guide in an inserting direction that is at an incline to a clamping direction.

25. Chin rest in accordance with claim 24, wherein the at least one support foot is at least one of (i) lockably rotatably, (ii) lockably swivelably and (iii) lockably tiltably fixable to the chin support.

26. Chin rest in accordance with claim 25, wherein:

the chin support comprises a first circular arc element which forms a first circular arc area, and the at least one support foot comprises a second circular arc element which forms a second circular arc area which is supported on the first circular arc area.

* * * * *